US006808069B1

(12) United States Patent
O'Toole

(10) Patent No.: US 6,808,069 B1
(45) Date of Patent: Oct. 26, 2004

(54) RACK PACKAGING FOR HAIRBRUSHES

(75) Inventor: Lawrence O'Toole, Philadelphia, PA (US)

(73) Assignee: Scünci International, Inc., Hatboro, PA (US)

( * ) Notice: Subject to any disclaimer, the term of this patent is extended or adjusted under 35 U.S.C. 154(b) by 22 days.

(21) Appl. No.: 10/439,031

(22) Filed: May 14, 2003

(51) Int. Cl.[7] ..... B65D 83/10

(52) U.S. Cl. ..... 206/362.3; 206/15.3; 206/362.4; 206/477; 206/806; 211/65

(58) Field of Search ..... 206/361, 362.2–362.4, 206/15.2, 15.3, 376, 461, 464, 467, 470, 477–480, 483, 806; 211/65, 66, 70.6

(56) References Cited

U.S. PATENT DOCUMENTS

| | | | | | |
|---|---|---|---|---|---|
| 2,609,920 | A | * | 9/1952 | Ringler | 206/362.4 |
| 2,841,273 | A | | 7/1958 | Scott | |
| 2,850,160 | A | | 9/1958 | Siebel et al. | |
| 2,855,649 | A | | 10/1958 | Kanter | |
| 4,014,436 | A | | 3/1977 | Tunis | |
| 4,032,005 | A | | 6/1977 | Vereb | |
| 4,039,079 | A | | 8/1977 | Laughton | |
| 4,116,334 | A | | 9/1978 | Herzog | |
| 4,184,279 | A | | 1/1980 | Peilet | |
| 4,190,151 | A | | 2/1980 | Russell | |
| 4,207,977 | A | | 6/1980 | Kronfeld et al. | |
| 4,606,456 | A | | 8/1986 | Kaminski | |
| 4,634,005 | A | * | 1/1987 | Kulzer et al. | 206/477 |
| 4,711,352 | A | * | 12/1987 | Williams et al. | 206/478 |
| 4,736,483 | A | | 4/1988 | Jiang | |
| D305,302 | S | | 1/1990 | Beatrice et al. | |
| D312,272 | S | | 11/1990 | Takamatsu et al. | |
| 5,191,973 | A | * | 3/1993 | Shteynberg | 206/362.4 |
| 5,375,717 | A | * | 12/1994 | Roshdy | 206/477 |
| D364,342 | S | | 11/1995 | Ruff | |
| 5,515,966 | A | | 5/1996 | Hodge et al. | |
| 5,593,041 | A | | 1/1997 | Capozzi | |
| 5,697,502 | A | | 12/1997 | Linz | |
| 5,740,908 | A | | 4/1998 | Anzalone | |
| 5,791,470 | A | | 8/1998 | Usui | |
| 5,819,919 | A | | 10/1998 | O'Neal | |
| 5,961,043 | A | | 10/1999 | Samuelson et al. | |
| D419,064 | S | | 1/2000 | Gorry | |
| 6,076,685 | A | | 6/2000 | Ramirez | |
| 6,237,762 | B1 | | 5/2001 | Faircloth | |
| 6,302,269 | B1 | | 10/2001 | Risch | |

* cited by examiner

*Primary Examiner*—Luan K. Bui
(74) *Attorney, Agent, or Firm*—Drinker Biddle & Reath LLP

(57) ABSTRACT

Packaging for hairbrushes includes a foldable display member having a main panel for mounting a hairbrush and upper and lower flaps extending obliquely and downwardly from an edge of the main panel. The flaps are deflectable into an arcuate configuration in which the flaps overly a portion of a mounted hairbrush. The arcuately-deflected flaps are secured by attachment to the main panel or alternatively by attachment to a mounted hairbrush below a lower edge of the main panel. The flaps may include attachment tabs receivable in openings of the main panel. Alternatively, the flaps may include openings for receiving a flexible connector for securing the flap to the main panel or to the handle of a mounted hairbrush.

18 Claims, 9 Drawing Sheets

RACK PACKAGING FOR HAIRBRUSHES

FIELD OF THE INVENTION

The invention relates generally to packaging and more particularly to packaging for displaying hairbrushes.

BACKGROUND OF THE INVENTION

Known packaging for rack display of hairbrushes includes a display member made from paperboard and having a main panel to which the hairbrush is secured. The main panel includes an opening that is adapted to receive a mounting peg of a rack display system for hanging display of the hairbrush.

It is also known, as disclosed in commonly assigned U.S. patent application Ser. No. 10/242,192, filed Sep. 12, 2002, to provide a hairbrush display member having a barrier panel extending perpendicularly from one side of a main panel. A resilient reinforcement member is secured to the barrier panel to maintain the barrier panel in an arcuate configuration.

SUMMARY OF THE INVENTION

According to the present invention, packaging is provided for displaying a hairbrush. The packaging includes a main panel having opposite first and second side edges and opposite upper and lower edges. The main panel also including a front surface for mounting a hairbrush. The packaging also includes upper and lower flaps connected to the first side edge of the main panel. At least a portion of each of the flaps extends obliquely and downwardly with respect to the main panel. Each panel is also deflectable into an arcuate configuration in which the flap overlies a portion of a hairbrush mounted on the main panel. The packaging further including a flap-attachment portion connected to at least one of the flaps. The flap-attachment portion is connected to a terminal end of the flap opposite the main panel and contacts a rear surface of the main panel adjacent the second side edge for securing the flap in the arcuate configuration.

According to one embodiment of the invention, the upper and lower flaps extend linearly from the main panel when the flaps are undeflected. The lower flap is located adjacent a lower edge of the main panel and includes a pair of openings adjacent a terminal end of the lower flap for securing the lower flap in the arcuate configuration to a portion of a mounted hairbrush. The flap-attachment portion connected to the upper flap includes a pair of openings positioned for alignment with a pair of openings in the main panel. The packaging includes a flexible connector received through the aligned openings to secure the flap-attachment portion to the main panel.

The main panel includes a notch in the first side edge between the upper and lower flaps. The lower edge of the main panel is also obliquely angled with respect to the side edges of the main panel such that the flaps and a portion of the main panel simulate a single flap continuously encircling a mounted hairbrush.

According to another embodiment of the invention, the upper and lower flaps extend non-linearly from the main panel when the flaps are undeflected. The lower flap is connected to the first side edge adjacent a lower edge the main panel. The lower edge of the main panel is curved to provide for superposition of the lower flap with respect to the lower edge of the main panel. The packaging includes a flap-attachment member connected to each of the upper and lower flaps. The flap-attachment member includes first and second tabs adapted for engagement with an opening in the main panel.

DETAILED DESCRIPTION OF THE PREFERRED EMBODIMENTS

Figure 1:
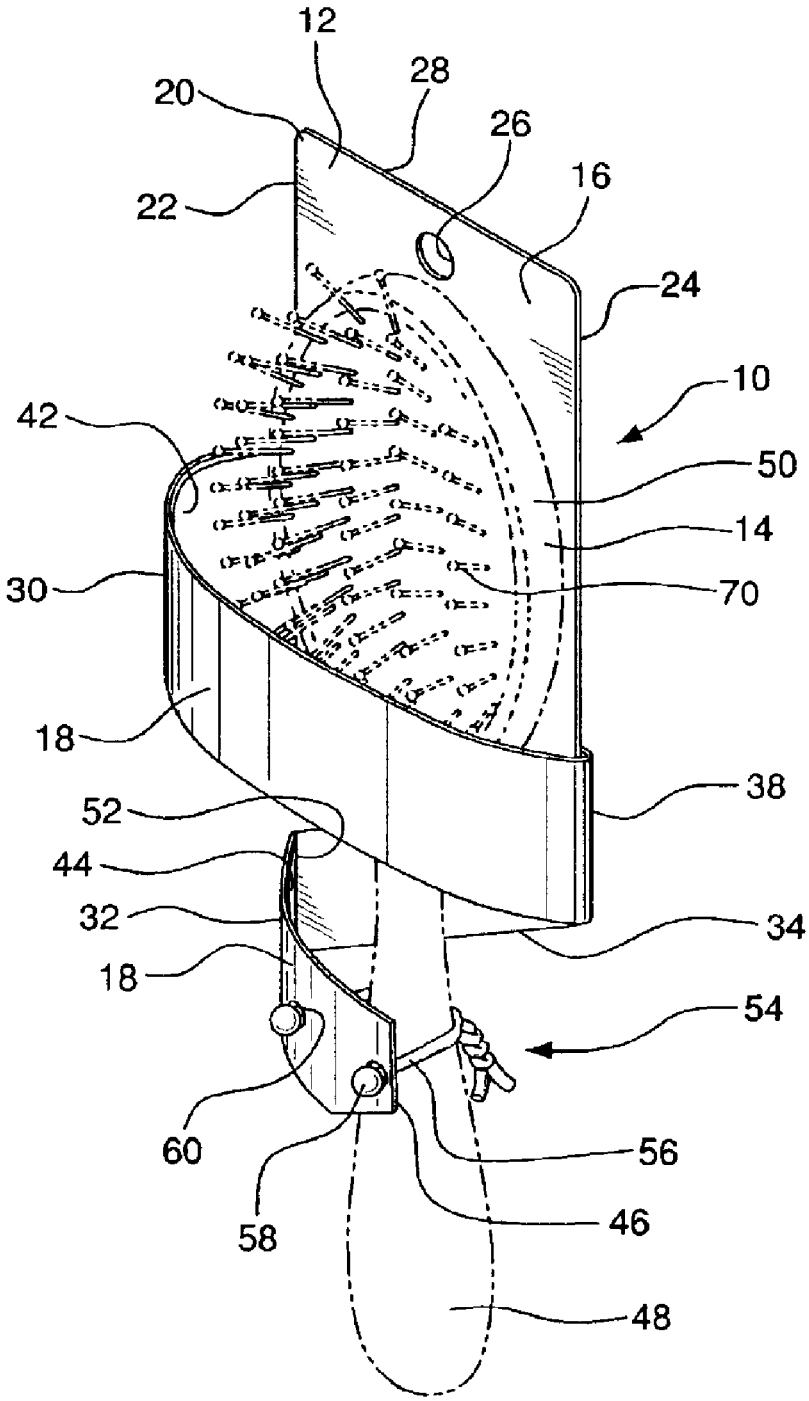
FIG. 1 is a front perspective view of packaging according to the present invention secured to a hairbrush for hanging display.

Referring to the drawings, where like numerals identify like elements, there is illustrated packaging 10 according to the present invention. As shown in FIG. 1, the packaging 10 includes a display member 12 providing hanging display of a hairbrush 14 secured to the display member.

The display member 12 includes opposite surfaces 16, 18 and is preferably made from a foldable material, such as paperboard or cardboard. The foldable display member 12 is illustrated in an unfolded blank condition showing surface 16, which defines a front surface for the display member 12. The display member 12 includes a main panel 20 having opposite sides 22, 24 and receiving a portion of a hairbrush on surface 16 for display by the packaging 10. An opening 26 is included in the main panel 20 adjacent a top end 28 of the main panel for receipt of a peg or hook of a rack display system for hanging display of a hairbrush by packaging 10.

Figure 2:
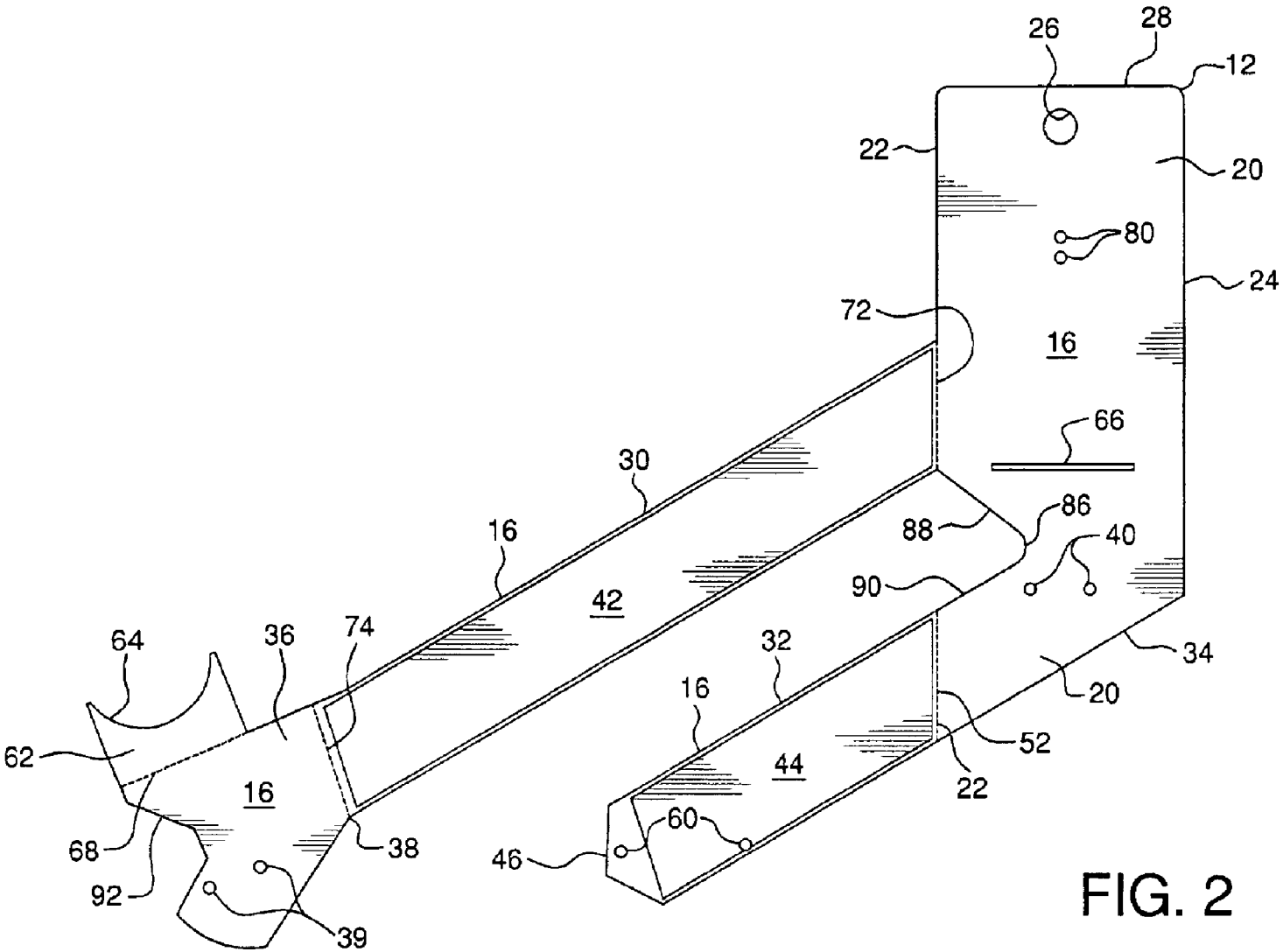
FIG. 2 is a front view of a first surface of the foldable display member of the packaging of FIG. 1 shown in an unfolded condition.

The display member 12 further includes upper and lower flaps 30, 32 extending from side 22 of main panel 20 with the lower flap 32 located adjacent a bottom end 34 of the main panel. As shown in FIG. 2, the upper and lower flaps 30, 32 extend substantially parallel to each other from side 22. For reasons to be described in greater detail, the flaps are obliquely oriented with respect to side 22 such that the flaps extend downwardly with respect to main panel 20.

The display member 12 includes a flap-securing portion 36 adjacent an end 38 of upper flap 30 opposite main panel 20. The flap-securing portion 36 is adapted for contact between surface 16 of the flap-securing portion 36 and surface 18 of main panel 20 opposite a received hairbrush when the upper flap 30 is placed in the arcuate configuration shown in FIG. 1. The flap-securing portion 36 of display member 12 includes a pair of openings 39. The openings 39 are positioned on the flap-securing portion 36 to provide for substantial alignment with a pair of openings 40 included in the main panel 20.

The display member 12 includes a flap-reinforcing member 42 of a resilient material, preferably plastic, secured to surface 16 of upper flap 30. The flap-reinforcing member 42 prevents the foldable upper flap 30 from folding upon itself in the arcuate configuration shown in FIG. 1 in which the upper flap 30 extends between main panel sides 22, 24 over a portion of hairbrush 14. Hairbrush packaging including a foldable display member having a resiliently reinforced flap adapted to form an arcuate configuration over a received hairbrush is disclosed in commonly assigned U.S. patent application Ser. No. 10/242,192, filed Sep. 12, 2002, which is hereby incorporated by reference. The display member 12 further includes a second flap-reinforcing member 44 secured to surface 16 of lower flap 32. In a similar fashion to the flap-reinforcing member 42 of upper flap 30, flap-reinforcing member 44 prevents the lower flap 32 from folding upon itself to provide for resilient deformation of the flap.

As described above, the upper and lower flaps 30, 32 are obliquely oriented with respect to side 22 of main panel 20 to extend downwardly. As a result, end 38 of upper flap 30 is positioned adjacent bottom end 34 of main panel 20 when the upper flap is placed in the arcuate configuration shown in FIG. 1. The downward extension of lower flap 32, which is connected to the main panel 20 adjacent bottom end 34, positions a terminal end 46 of the lower flap 32 below the main panel 20 for contact with a handle 48 of the received hairbrush 14. The lower flap 32 is shorter in length than the upper flap 30 such that the end 46 of the lower flap 32 is positioned in front of hairbrush 14 for contact between surface 16 and handle 48.

Figure 3:
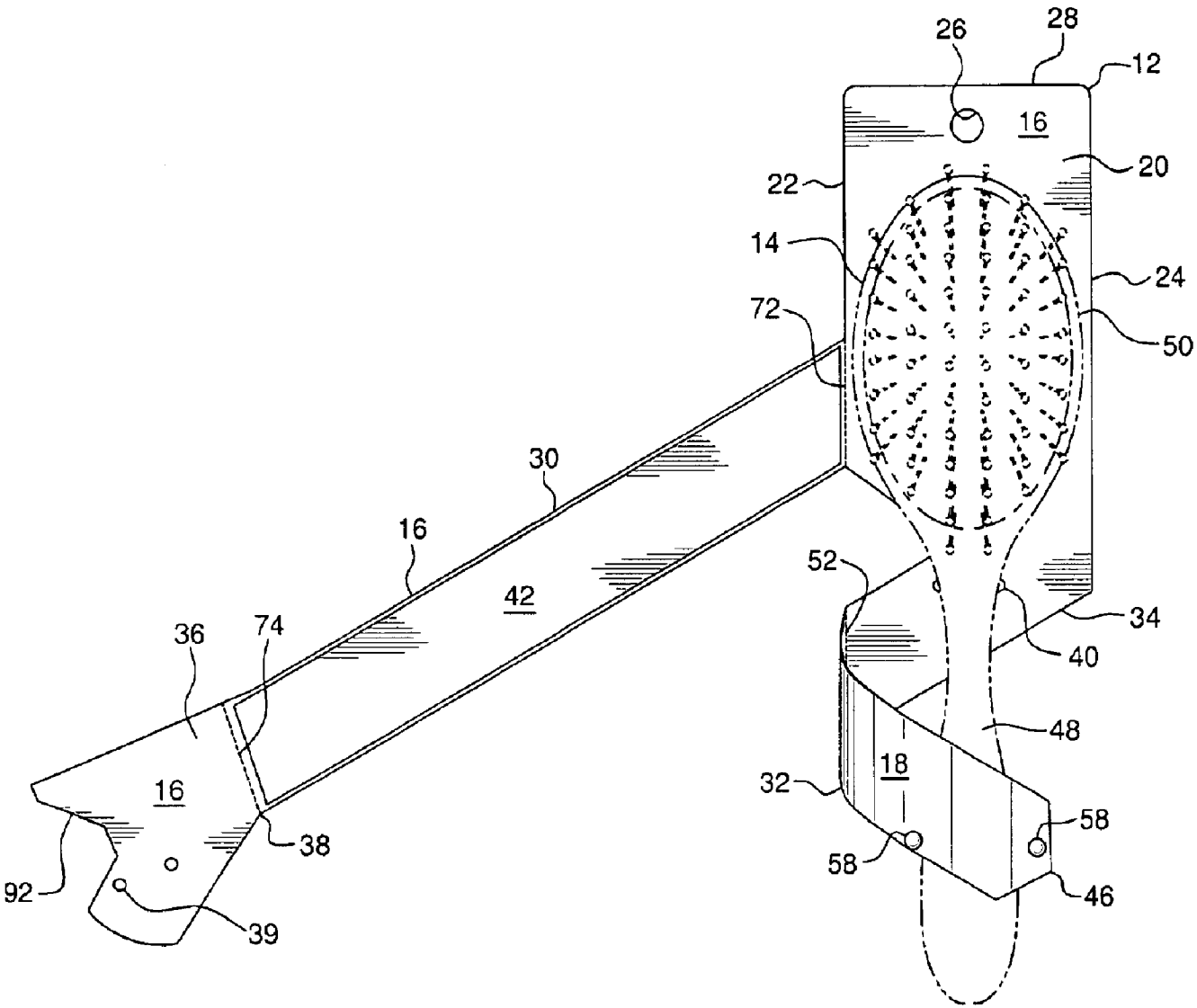
FIG. 3 is a front view of the foldable display member of FIG. 1 showing the lower flap secured to the handle of the hairbrush.

Referring to FIG. 3, packaging 10 is formed in the following manner, not necessarily in the order presented. Hairbrush 14 is positioned on the foldable display member 12 such that a head portion 50 of hairbrush 14 is received on surface 16 of main panel 20. Lower flap 32 is deflected to position end 46 in front of the received hairbrush 14. The display member 12 includes a fold line 52 adjacent side 22 of main panel 20 to facilitate the desired positioning of the lower flap 32. As shown in FIG. 1, the lower flap 32 is secured to the handle 48 of hairbrush 14 by a connector 54. The connector 54 includes a pair of flexible ties 56 each having an enlarged head 58 at an end. The flexible ties 56 of connector 54 are received in openings 60 in the lower flap 32 sized to prevent passage of the tie heads 58. As shown in FIG. 1, the ties 56 are received by the lower flap 32 from surface 18 and are twisted together on an opposite side of the handle 48, as shown in FIG. 1, to secure the lower flap 32 to the hairbrush 14.

As shown in FIG. 2, the foldable display member 12 includes an optional round brush support 62 attached to the flap-securing portion 36. As will be described in greater detail below, the support 62 includes an arcuate edge 64 for engagement with a round brush when the support 62 is received through a slot 66 in the main panel 20. The display member 12 includes a fold line 68 between the support 62 and the flap-securing portion 36. Referring again to FIG. 3, when the foldable display member 12 is not being used to package a round brush, the optional brush head support 62 is preferably removed from the display member 12, by cutting the display member along fold line 68 for example.

Figure 4:
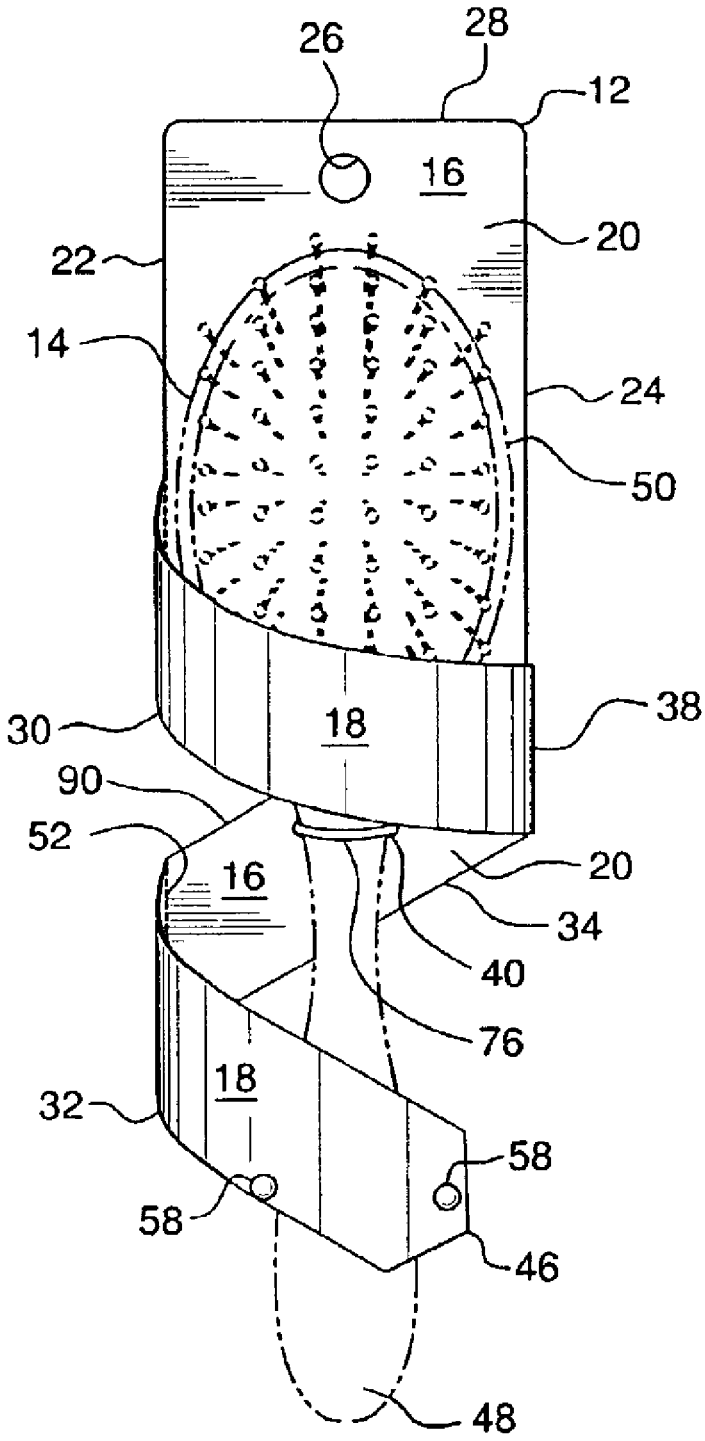
FIG. 4 is a front view of the packaging of FIG. 1.
Figure 5:
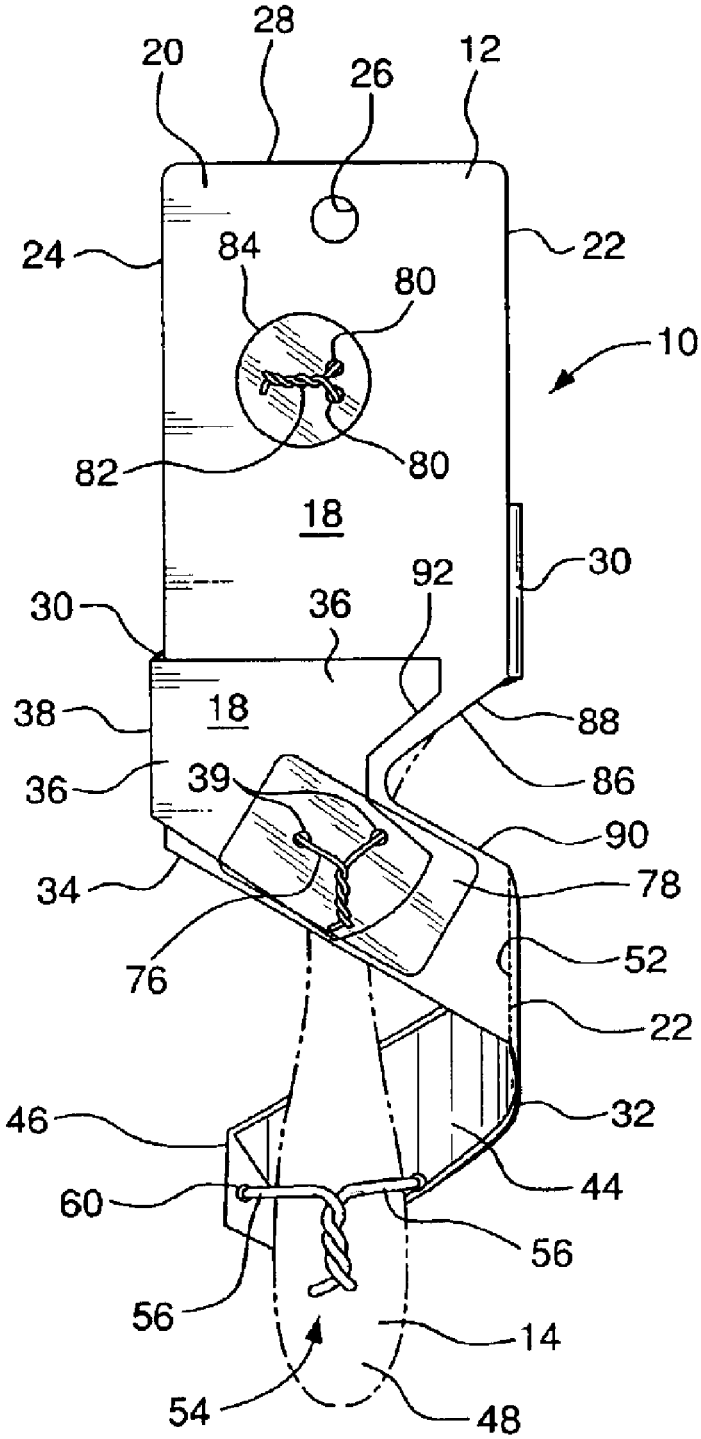
FIG. 5 is a rear view of the packaging of FIG. 1.

Referring to FIGS. 4 and 5, the upper flap 30 is deflected to the arcuate configuration in which end 38 is adjacent bottom end 34 of main panel 20 and flap 30 extends between main panel sides 22, 24 over a portion of hairbrush 14. In the arcuate configuration, the upper flap 30 forms a barrier with the main panel 20 extending around hairbrush 14. This barrier, however, does not enclose the hairbrush 14, which desirably leaves a majority of the hairbrush head portion 50 exposed for tactile examination of bristles 70 by a potential purchaser for example.

The foldable display member 12 includes a fold line 72 between the main panel 20 and the upper flap 30 to facilitate deflection of the upper flap 30 into the arcuate configuration. The display member 12 also includes a fold line 74 between the upper flap 30 and the flap-securing portion 36. The fold line 74 facilitates contact between surface 16 of the flap-securing portion 36 and surface 18 of main panel 20 as shown in FIG. 5.

The packaging 10 includes a flexible tie 76 having opposite ends received through openings 40 in main panel 20 over handle 48 to secure hairbrush 14 to the main panel 20. The ends of the flexible tie 76 are also received through holes 39 in the flap-securing portion 36, which are aligned with the holes 40 in main panel 20. The ends of the flexible tie 76 are twisted together as shown in FIG. 5. The engagement between tie 76 and display member 12 functions both to secure the hairbrush 14 to the display member 12 and to secure the flap-securing portion 36 to the main panel 20. As shown in FIG. 5, the packaging 10 may include a cover member 78 to further secure the packaging 10 in the assembled condition. The cover member 78 includes an adhesive layer and is secured to the flap-securing portion 36 and the main panel 20 over the flexible tie 39.

The display member 12 includes a pair of openings 80 in the main panel 20 between the rack peg opening 26 and the slot 66. The openings 80 provide for optional connection between the main panel and the head portion of a hairbrush. The openings 80 could be used, for example, to mount a vent brush having openings in the head portion for airflow. As shown in FIG. 5, opposite ends of a flexible tie 82 are received through openings 80 and are twisted together. An adhesive coated cover member 84 may be placed over the twisted ends of flexible tie 82 to further secure the connection.

Referring again to FIG. 2, the main panel 20 of display member 12 includes a substantially triangular notch 86. The notch 86, located between upper and lower flaps 30, 32, includes edges 88, 90. As shown in FIG. 5, the flap-securing portion 36 of display member 12 includes a notch 92 such that notch 86 in main panel 20 remains uncovered when the flap-securing portion 36 contacts surface 18 of main panel 20. The bottom end 34 of the main panel extends obliquely and downwardly between sides 24 and 22 such that it is substantially parallel with edge 90 of notch 86. As best seen in FIG. 4, the construction of notch 86 and bottom end 34 creates the illusion of a continuous downward spiral beginning at fold line 72 between upper flap 30 and main panel 20 and ending at the terminal end 46 of the lower flap 32.

Figure 6:
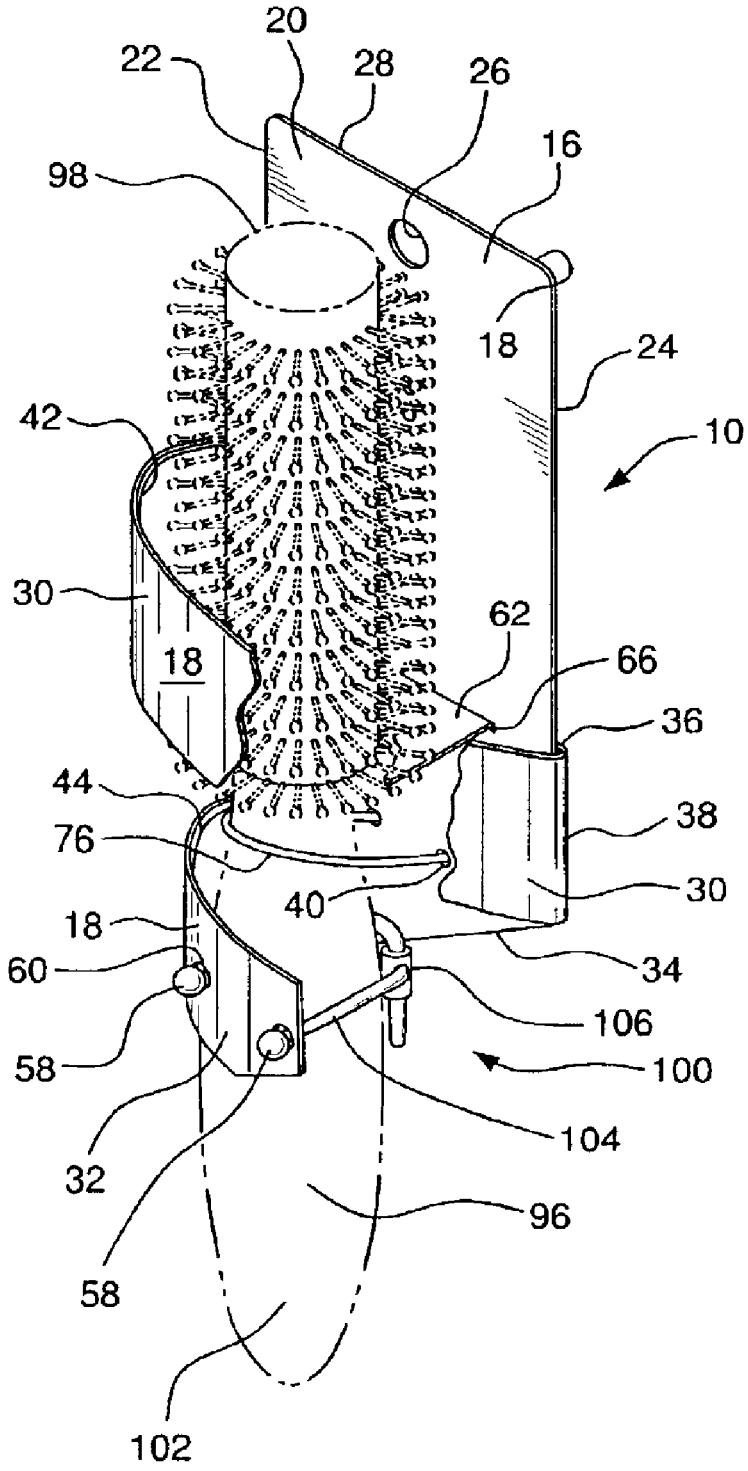
FIG. 6 is a front perspective view of a round hairbrush secured to the foldable display member of FIG. 2 with a portion of the upper flap removed for clarity of the view.

Referring now to FIG. 6, there is illustrated packaging 94 providing for hanging display of a round brush 96 having a cylindrical head portion 98. The packaging includes a foldable display member 12 identical in construction to that shown in FIG. 2. The brush head support 62, which was removed for packaging hairbrush 14, is included in packaging 94. As shown, the support 62 is received through the slot 66 in main panel 20 to extend from surface 16 when the flap-securing portion 36 contacts surface 18 of main panel 20.

In a similar manner as packaging 10, the packaging 94 includes a flexible tie 76 having opposite ends received through openings 40 in the main panel and aligned openings 39 in the flap-securing portion 36. Packaging 94 also includes a connector 100 for securing the lower panel 32 of display member 12 to a handle 102 of round hairbrush 96. The connector 100 includes a pair of flexible ties 104 each having an enlarged head 58 in a similar manner as the flexible ties 56 of packaging 10. The connector 100 of packaging 94, however, includes a one-way locking mechanism 106, per se known, for securing the flexible ties together and preventing separation of the lower flap 32 from the handle 102 absent cutting of one of the flexible ties 104 or cutting of the lower panel 32 itself, for example.

Figure 7:
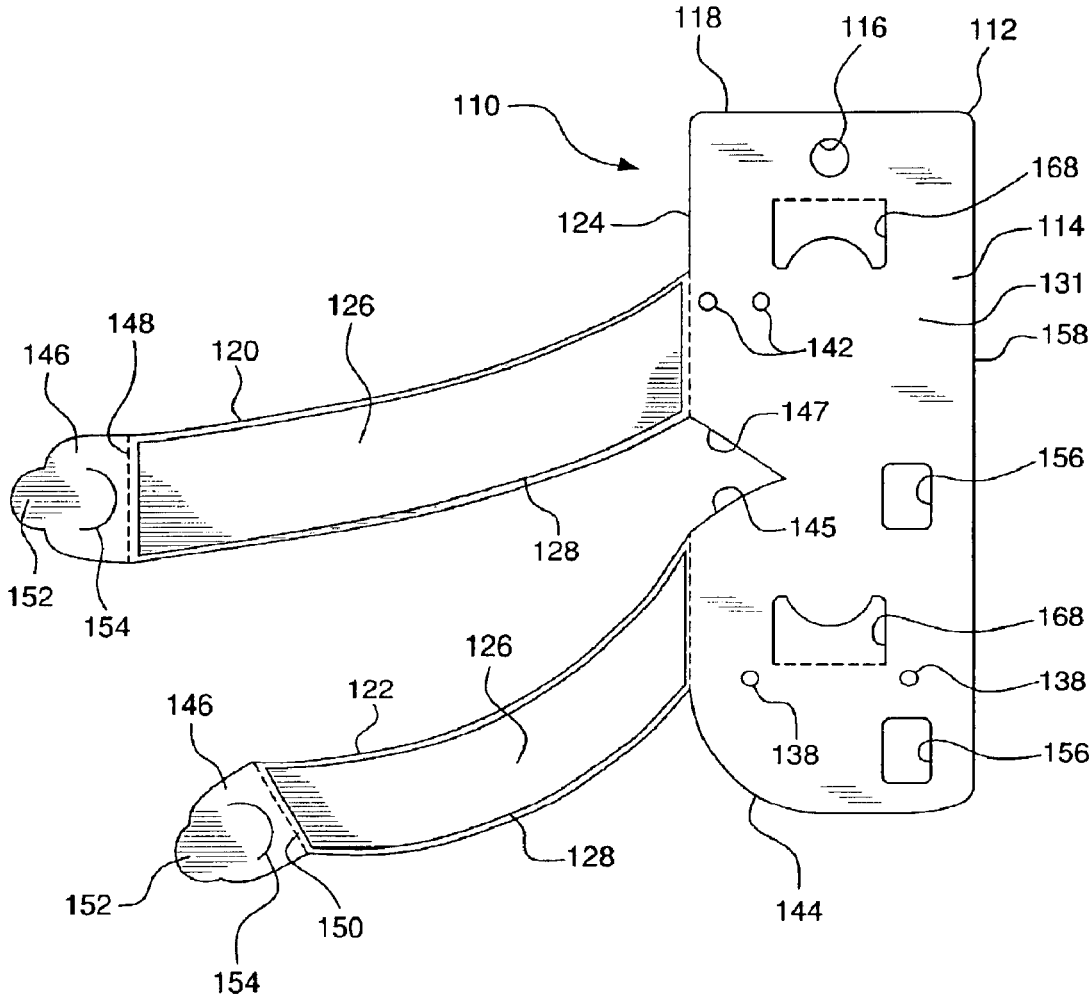
FIG. 7 is a front view of a foldable display member according to a second embodiment of the present invention.
Figure 8:
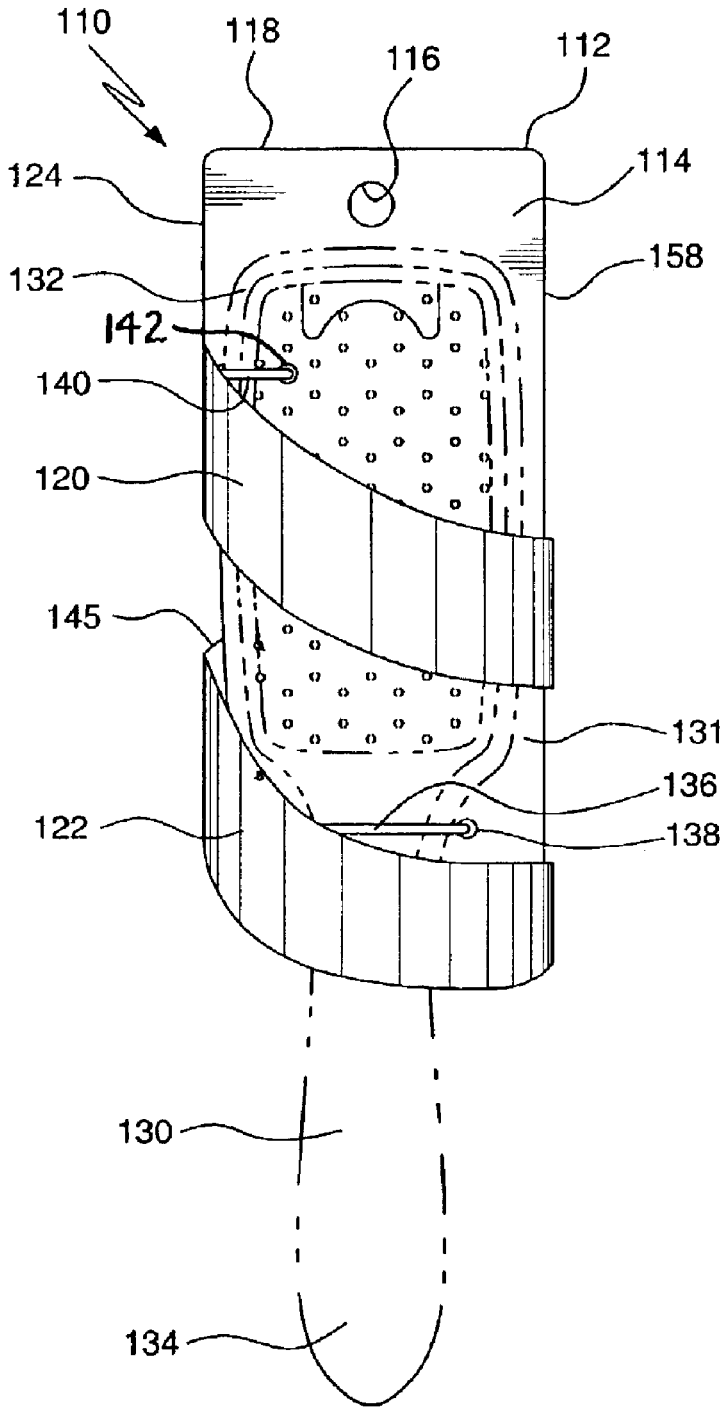
FIG. 8 is a front view of the foldable display member of FIG. 7 secured to a hairbrush for hanging display.
Figure 9:
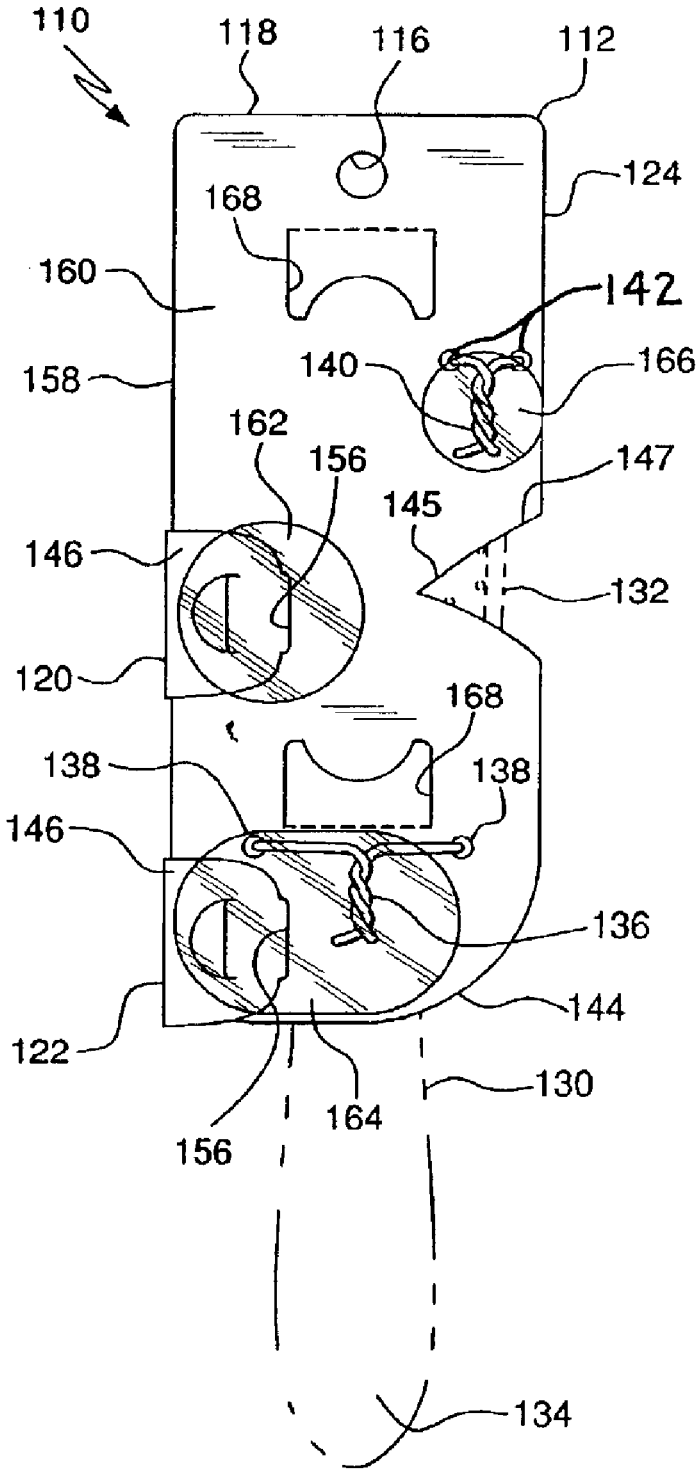
FIG. 9 is a rear view of the foldable display member and secured hairbrush of FIG. 8.

Referring to FIGS. 7–9, there is illustrated hairbrush packaging 110 according to a second embodiment of the invention. The packaging 110 includes a foldable display member 112 according to a second embodiment of the present invention. The display member 112 is shown in FIG. 7 in an unfolded blank condition. The display member 112 includes a main panel 114 having an opening 116 adjacent an upper edge 118 for hanging display from a rack display peg. The display member 112 includes upper and lower flaps 120, 122 extending from a first side edge 124 of the display member 112. Each of the upper and lower flaps 120, 122 includes a resilient reinforcement member 126 secured to a surface 128 of the flap. Each of the upper and lower flaps 120, 122 is also oriented obliquely to the main panel 114 adjacent side edge 124 and extend downwardly. In contrast to the linearly-extending flaps 30, 32 of display member 12, however, each of flaps 120, 122 is upwardly curved.

Referring to FIG. 8, the display member 112 is shown with a vent brush 130 received on a front surface 131 of main panel 114 and secured thereto. The vent brush 130 includes a bristled head portion 132 and a handle portion 134. A first flexible connector 136, most preferably a twist tie, is received by spaced openings 138 in the main panel to secure the handle portion 134 of the vent brush 130 to the display member 112. The vent brush 130 is also secured to the display member 112 by a second flexible connector 140. The second connector 140 is received by closely spaced openings 142 in an upper portion of the main panel 114 and extends through a perforated, or open, section of the vent brush 130 adjacent an edge of the head portion 132.

Each of the flaps 120, 122, in a similar manner as flaps 30, 32 of display member 12, is deflected across the secured vent brush 130 in an arcuate configuration made possible by the resilient reinforcement members 126. Because of the above-described upward curvature, both of the flaps 120, 122 extend over the main panel 114 in the arcuately-formed condition shown in FIG. 8. As shown in FIG. 7, a lower edge 144 of the main panel 114 is curved. The curvature of the main panel edge 144 provides for superposition of the respective edges of the lower flap 122 and the main panel 114 in the deflected-flap condition of the display member 112 shown in FIG. 8. The display member 112 also includes a notch 145 in the first side edge 124 of main panel 114. The notch 45 is positioned to provide for superposition between upper flap 120 and an edge 147 of the notch 145 when the upper flap 120 overlies the main panel 114. As shown in FIG. 8, the inclusion of notch 145 and the curved lower edge 144 serve to create an illusion of a single spiraling flap encircling the vent brush 130.

Referring again to FIG. 7, the display member 112 includes flap-attachment portions 146 connected to each of flaps 120, 122 at ends 148, 150 thereof. Each of the flap-attachment portions 146 includes first and second tabs 152, 154 respectively extending from, and formed within, the portion. The display member 112 further includes rectangular openings 156 in the main panel 114 adjacent a second side edge 158. Referring to the rear view shown in FIG. 9, the tabs 152, 154 are sized and positioned for receipt by the rectangular openings 156 when the flap-attachment portions 146 are positioned against a rear surface 160 of the main panel 114.

To firmly secure the connection between the tabs 152, 154 and the rectangular openings 156, the vent brush packaging 110 preferably includes cover members 162, 164 adhesively secured to the rear surface 160 of main panel 114. Cover member 164 is sized and dimensioned to overly the flap-attachment portion 146 of lower flap 122 and also to overly the joined end portions of the first flexible connector 136. Preferably the packaging also includes a cover member 166 received over joined end portions of the second flexible connector 140.

The display member 112 further includes foldable brush supports 168 integrally formed in the main panel 114. The brush supports 168 provide for optional support of the cylindrical head portion of a round brush.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. Packaging for displaying a hairbrush, the packaging comprising:

a main panel having opposite first and second side edges and opposite upper and lower edges, the main panel having a front surface for mounting a hairbrush;

upper and lower elongated flaps connected to the first side edge of the main panel, at least a portion of each flap extending obliquely and downwardly with respect to the main panel, each flap being deflectable into an arcuate configuration in which the flap overlies a portion of a hairbrush mounted on the main panel; and a flap-attachment portion connected to at least one of the flaps, the flap-attachment portion connected to a terminal end of the flap opposite the main panel, the flap-attachment portion contacting a rear surface of the main panel adjacent the second side edge for securing the flap in the arcuate configuration.

2. The packaging according to claim 1 further comprising at least one flexible connector received by a pair of openings in the main panel for securing a hairbrush to the main panel.

3. The packaging according to claim 1 further comprising a resilient reinforcement member secured to each of the flaps to facilitate deflection of the flaps into the arcuate configuration.

4. The packaging according to claim 1, wherein each of the flaps extends substantially linearly from the first side edge of the main panel when the flap is undeflected and wherein the lower flap is connected to the main panel adjacent a lower edge of the main panel, the lower flap including a pair of openings adjacent a terminal end of the flap for receiving a flexible connector to secure the flap to a mounted hairbrush.

5. The packaging according to claim 4, wherein the main panel includes a notch in the first side edge between the upper and lower flaps and wherein the lower edge of the main panel is angled obliquely with respect to the side edges such that the flaps and a portion of the main panel simulate a single flap continuously encircling a mounted hairbrush.

6. The packaging according to claim 4, wherein the flexible connector for securing the lower flap to a mounted hairbrush includes first and second portions each received by one of the openings in the lower flap, each of the first and second portions of the flexible connector including an enlarged head portion.

7. The packaging according to claim 6, wherein the lower flap connector includes a locking mechanism, the locking mechanism secured to one of the connector portions and adapted for receiving the other of the connector portions.

8. The packaging according to claim 1, wherein the flap-attachment portion includes a pair of openings positioned for alignment with a pair of openings in the main panel adjacent the second side edge thereof, and wherein the packaging further comprises a flexible connector receivable through the aligned openings of the flap-attachment portion and the main panel.

9. The packaging according to claim 1, wherein the flap-attachment portion includes first and second tabs adapted for engagement with an opening in the main panel.

10. The packaging according to claim 1, wherein a flap-attachment portion is connected to each of the upper and lower flaps for securing the flap to the main panel in an arcuate configuration.

11. The packaging according to claim 10, wherein the lower flap extends non-linearly from the first side edge when the lower flap is undeflected and wherein a lower edge of the main panel is correspondingly curved to provide for substantial superposition between the lower flap and the lower edge of the main panel with the lower flap in the arcuate configuration.

12. The packaging according to claim 1, wherein the main panel includes a pair of closely spaced openings in an upper portion thereof, and wherein the packaging includes a flexible connector receivable through a perforated portion of a vent hairbrush for securing the hairbrush to the main panel.

13. The packaging according to claim 1 further including a brush support member connected to the flap-attachment portion, and wherein the main panel includes a slot for receiving the brush support member when the flap-attachment portion contacts the main panel, the brush support member including a curved edge for engagement with a round hair brush.

14. The packaging according to claim 1, further including at least one cover member adhesively secured over a portion of the flap-attachment portion for securing the connection between the flap-attachment portion and the main panel.

15. The packaging according to claim 14 further comprising at least one flexible connector received by a pair of openings in the main panel for securing a hairbrush to the main panel and wherein at least one of the covers is secured over a portion of the flexible connector.

16. Packaging for hanging display of a hairbrush, the packaging comprising:

a main panel having opposite first and second side edges and opposite upper and lower edges, the main panel having a front surface for mounting a hairbrush;

upper and lower elongated flaps connected to the first side edge of the main panel and extending obliquely and downwardly with respect to the main panel, each flap extending substantially linearly in an undeflected condition from the main panel and being deflectable into an arcuate configuration in which the flap overlies a portion of a hairbrush mounted on the main panel, the lower flap including a pair of openings adapted for receipt of a flexible connector for securing the lower flap to a portion of a hairbrush mounted to the main panel; and a flap-attachment portion connected to a terminal end of the upper flap, the flap-attachment portion contacting a rear surface of the main panel adjacent the second side edge for securing the flap in the arcuate configuration.

17. The packaging according to claim 16, wherein the flap-attachment portion includes a pair of openings positioned for alignment with a pair of openings in the main panel, the packaging further including a flexible connector receivable by the aligned openings of the flap-attachment portion and the main panel for securing the flap-attachment portion to the main panel.

18. Packaging for hanging display of a hairbrush, the packaging comprising:

a main panel having opposite first and second side edges and opposite upper and lower edges, the main panel having a front surface for mounting a hairbrush;

upper and lower elongated flaps connected to the first side edge of the main panel and extending obliquely and downwardly with respect to the main panel, each flap extending non-linearly in an undeflected condition from the main panel and being deflectable into an arcuate configuration in which the flap overlies a portion of a hairbrush mounted on the main panel; and a flap-attachment portion connected to a terminal end of each of the upper and lower flaps, the flap-attachment portion including first and second tabs adapted for engagement with an opening in the main panel.

* * * * *